US011066922B2

(12) United States Patent
Moriarty

(10) Patent No.: US 11,066,922 B2
(45) Date of Patent: Jul. 20, 2021

(54) MOUNTING ELECTRONICS AND MONITORING STRAIN OF ELECTRONICS

(71) Applicant: Schlumberger Technology Corporation, Sugar Land, TX (US)

(72) Inventor: Keith Moriarty, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 245 days.

(21) Appl. No.: 15/759,529

(22) PCT Filed: Aug. 31, 2016

(86) PCT No.: PCT/US2016/049552
§ 371 (c)(1),
(2) Date: Mar. 13, 2018

(87) PCT Pub. No.: WO2017/048508
PCT Pub. Date: Mar. 23, 2017

(65) Prior Publication Data

US 2019/0145244 A1 May 16, 2019

Related U.S. Application Data

(60) Provisional application No. 62/218,680, filed on Sep. 15, 2015.

(51) Int. Cl.
*E21B 47/017* (2012.01)

(52) U.S. Cl.
CPC ..... *E21B 47/017* (2020.05)

(58) Field of Classification Search
CPC ..... E21B 47/011
USPC ..... 73/866.5
See application file for complete search history.

(56) References Cited

U.S. PATENT DOCUMENTS 5,134,285 A 7/1992 Perry et al.
6,012,537 A * 1/2000 Rountree ..... E21B 4/02 166/242.1
6,928,948 B1 * 8/2005 Shannon ..... B63B 17/00 114/343
7,381,908 B1 * 6/2008 Cantatore ..... G01R 31/2808 174/535
2006/0043635 A1 3/2006 Groth
2006/0142945 A1 * 6/2006 McLaughlin ..... E21B 47/0006 702/9
2010/0218624 A1 * 9/2010 Atwood ..... B62D 55/12 73/865.8
2013/0003304 A1 * 1/2013 Woods, Jr. ..... H05K 7/142 361/707
2014/0312752 A1 10/2014 Durisotti et al.
(Continued)

OTHER PUBLICATIONS

International Search Report and Written Opinion issued in International Patent application PCT/US2016/049552, dated Dec. 22, 2016. 14 pages.

*Primary Examiner* — Marrit Eyassu

(57) ABSTRACT

A system for mounting electronics is disclosed. The system may include a tool and a chassis having a mounting surface. The system may also include an electronics assembly coupled to the chassis. A low modulus spacer may be coupled to the chassis between the mounting surface of the chassis and the electronics assembly. A fastener may couple the electronics assembly and the low modulus spacer to the chassis.

20 Claims, 6 Drawing Sheets

(56) References Cited

U.S. PATENT DOCUMENTS

| | | | | |
|---|---|---|---|---|
| 2015/0027736 | A1* | 1/2015 | Smaardyk et al. ... | E21B 47/007<br>166/381 |
| 2016/0007495 | A1* | 1/2016 | McKittrick ..... | G06F 1/1613<br>361/679.56 |
| 2017/0044890 | A1* | 2/2017 | Clark et al. ..... | E21B 47/022 |

* cited by examiner

MOUNTING ELECTRONICS AND MONITORING STRAIN OF ELECTRONICS

CROSS-REFERENCE TO RELATED APPLICATIONS

The present application claims priority to U.S. Provisional Application 62/218,680 filed Sep. 15, 2015, the entirety of which is incorporated by reference.

FIELD OF THE INVENTION

Some embodiments described herein generally relate to systems and apparatuses for mounting electronics. Additional embodiments generally relate to methods of attenuating strain transfer and monitoring strain in electronics.

BACKGROUND INFORMATION

In the drilling of oil and gas wells, particularly in directional drilling, the drill string may be subjected to bending as the wellbore is drilled. The drill string rotates during drilling operations and when a portion of the drill string encounters a bend in the borehole, that portion of the drill string may be subjected to increased fatigue loads and cycles as the drill string rotates within the bend. Increased fatigue loads, in the form of strain can lead to premature failure of the drill string.

Printed circuit boards and electronic components may be coupled to the chassis of a drill string. Fatigue loads imparted on the printed circuit boards and electronic components coupled to the printed circuit boards, particularly fatigue loads in the form of strain transferred from the drill string chassis to the printed circuit boards, can reduce the life of the printed circuit boards.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

A system for mounting electronics is disclosed. In one non-limiting embodiment, the system includes a tool and a chassis having a mounting surface. The system also includes an electronics assembly coupled to the chassis. A low modulus spacer may be coupled to the chassis between the mounting surface of the chassis and the electronics assembly. A fastener may couple the electronics assembly and the low modulus spacer to the chassis.

A non-limiting method of mounting electronics is disclosed. The method includes mounting a low modulus spacer onto a surface of a chassis of a tool. The low modulus spacer may include opposing first and second surfaces. The first surface of the spacer may be in contact with the surface of the chassis. The method also includes mounting an electronics assembly to the low modulus spacer. The electronics assembly includes opposing third and fourth surfaces. The third surface of the assembly is in contact with the second surface of the low modulus spacer. The method includes coupling the electronics assembly and the low modulus spacer to the chassis with a fastener.

BRIEF DESCRIPTION OF THE SEVERAL VIEWS OF THE DRAWINGS

In the drawings, sizes, shapes, and relative positions of elements are not drawn to scale. For example, the shapes of various elements and angles are not drawn to scale, and some of these elements may have been arbitrarily enlarged and positioned to improve drawing legibility.

DETAILED DESCRIPTION

Figure 1:
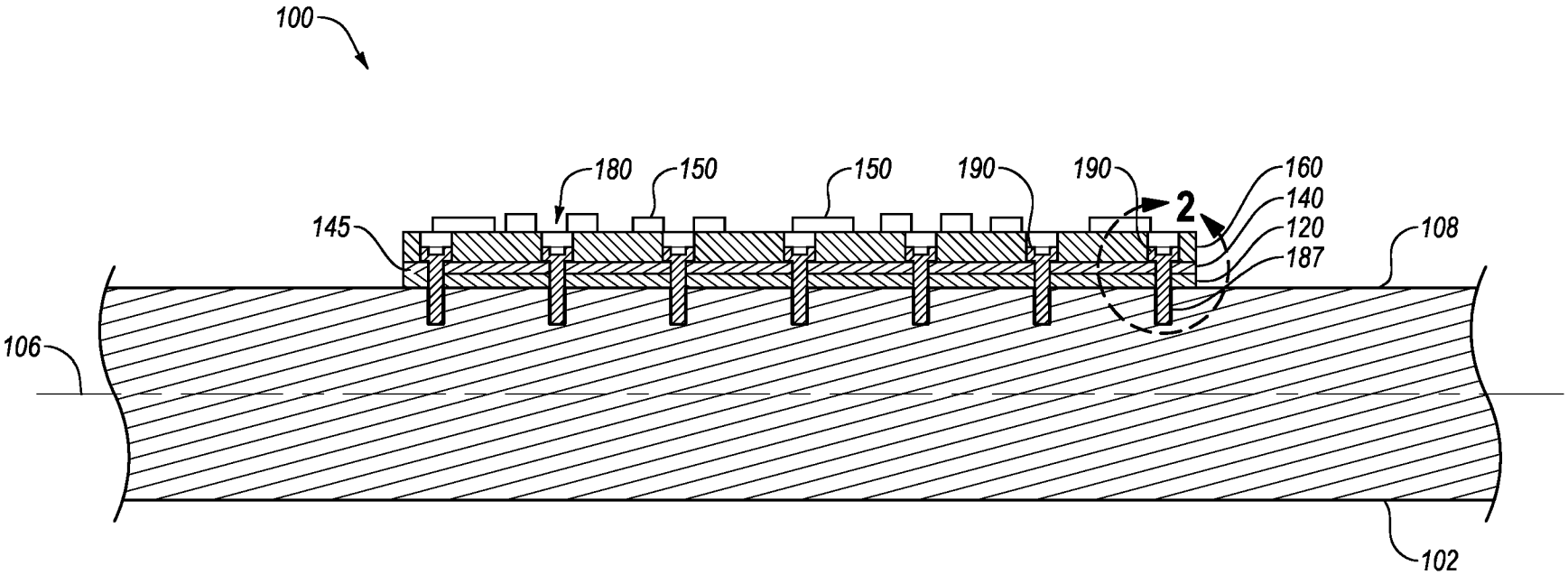
FIG. 1 depicts a cross-sectional view of a printed circuit board coupled to a chassis, according to one or more embodiments disclosed herein.

FIG. 1 depicts a tool 100 that includes an electronics assembly 140 coupled to a tool chassis 102. The tool 100 may be, for example, a downhole tool such as a measurement while drilling tool, a logging while drilling tool, a rotary steerable system, or other type of downhole tool. The electronics assembly 140 may include a circuit board 145, such as a printed circuit board, with electronic components 150.

The electronic components 150 may be active, such as processors, memory, and integrated logic chips, or they may be passive, such as resistors, inductors, and capacitors. The electronic components 150 may also be other controller hardware, communication hardware, or other electronic components or devices. The electronic components 150 may be coupled to the circuit board 145 of the electronic assembly 140. In some embodiments, the electronic components 150 include leads that are soldered to through holes or pads on the printed circuit board 145. The solder that couples the electronic components 150 to the electronic assembly 140 may form both an electrical and a physical connection to the printed circuit board 145.

The electronic assembly 140 is coupled to the chassis 102 of the tool 100. The electronic assembly 140 may be coupled to the chassis 102 of the tool 100 using a combination of a frame 160, a low modulus spacer 120, and fasteners 190. The fasteners 190 clamp or otherwise couple the frame 160, electronics assembly 140, and low modulus spacer 120 to an outer surface 108 of the chassis 102.

Figure 2:
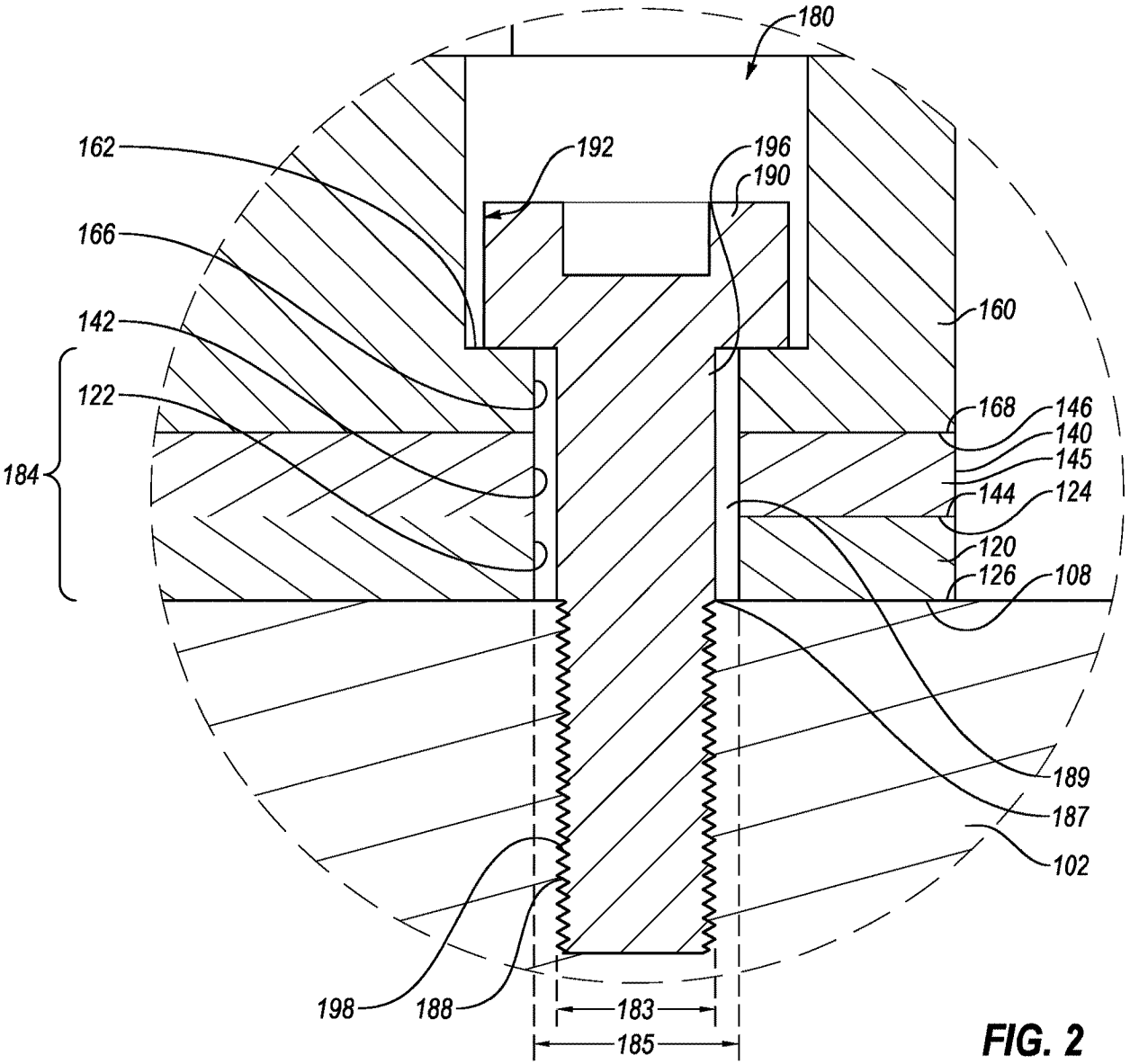
FIG. 2 depicts a detailed cross-sectional view of the printed circuit board coupled to the chassis of FIG. 1, according to one or more embodiments disclosed herein.

FIG. 2 depicts a detailed view of one of the fasteners 190 and the structure and arrangement of the components that couple the electronics assembly 140 to the chassis 102 of the tool 100. Each of the frame 160, the electronics assembly 140, the low modulus spacer 120, and the chassis 102 includes apertures 122, 142, 162, 187 that form a fastening aperture 180.

The chassis aperture 187 is a blind aperture with threads 188 that receive and engage with threads 198 of the fastener 190. In some embodiments the chassis aperture 187 may be a through aperture.

The chassis aperture 187 has a diameter 183 that may be the major or outer diameter of the threads 188. In some embodiments, the diameter 183 may be the same as the diameter of a shank 196 of the fastener 190.

The fastening aperture 180 may also include a clearance portion 184. The clearance portion 184 may include the aperture 122 in the low modulus material 120, the aperture 142 in the circuit board 145 of the electronics assembly 140, and the aperture 162 in the frame 160. The individual apertures 122, 142, 162 may have a diameter 185 that is greater than the diameter of the shank 196 of the fastener 190. This arrangement provides the clearance portion 184 of the aperture 180 with a diameter that is greater than the diameter of the shank 196 of the fastener 190.

In the embodiment shown in FIG. 2, the shank 196 is the portion of the fastener that passes through the clearance aperture of the assembled tool 100. In the embodiment of FIG. 2, the diameter of the clearance aperture 184 is greater than the diameter of the portion of the fastener that passes through the clearance portion 184 of the aperture 180 that includes the aperture 122 in the low modulus material spacer 120, the aperture 142 in the electronics assembly 140, and an aperture 166 of the frame 160.

The diameter 185 of the aperture 180 and the diameter of the portion of the fastener 190 that passes through the clearance diameter 184 may be sized such that there is a gap 189 between the outer surface of the shank 196 and the inner surface or surfaces of the clearance aperture 184. The gap 189 aids in reducing or preventing contact between the fastener 190, the frame 160, electronics assembly 140, and the low modulus material 120. In particular, the gap 189 aids in reducing or preventing such contact when the chassis 102 is bent, as discussed later with respect to FIGS. 3 and 4.

The fastener 190 engages with the frame 160 and the chassis 102 to clamp the frame 160, electronics assembly 140, and the low modulus material 120 to the chassis 102. The threads 198 of the fastener 190 engage with the threads 188 of the chassis aperture 187 and a head 192 of the fastener 190 engages with the shoulder 162 of the frame 160 to clamp the frame 160, electronics assembly 140, and the low modulus material 120 to the chassis 102.

As shown in FIG. 2, a surface 168 of the frame 160 contacts an upper surface 146 of the electronics assembly 140. An opposing, lower surface 144 of the electronics assembly 140 contacts an upper surface 124 of the low modulus spacer 120 and an opposing, lower surface 126 of the low modulus spacer 120 contacts the outer surface 108 of the chassis 102. The clamping force between the fastener 190 and the chassis 102 is imparted by one surface 108, 124, 126, 144, 146, 166, onto an adjacent surface 108, 124, 126, 144, 146, 166 to clamp the low modulus spacer 120, the electronics assembly 140, and the frame 160 to the chassis 102.

With a low modulus interface material, such as the low modulus spacer 120, inserted between electronics module 140 and the chassis 102, the tensile or compressive strain transmitted from the chassis 102 to the electronics printed circuit board 145 of the electronics assembly 140 and components 150 during bending may be attenuated. The strain from the high elastic modulus chassis 102, which may be made from durable materials such as steel, coupled to the low modulus material space 120 results in much lower relative stresses in the electronics module 140 as compared to the stress in the chassis 102, despite the electronics module 140 being further from the neutral axis 106 of the chassis 102.

Figure 3:
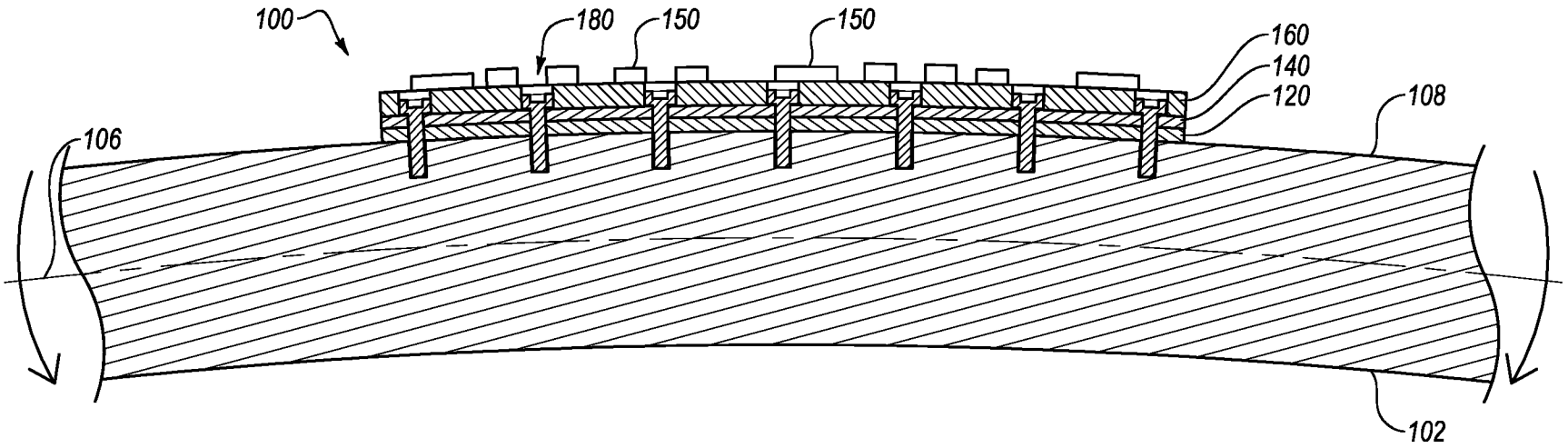
FIG. 3 depicts a cross-sectional view of a printed circuit board coupled to a chassis, according to one or more embodiments disclosed herein.
Figure 4:
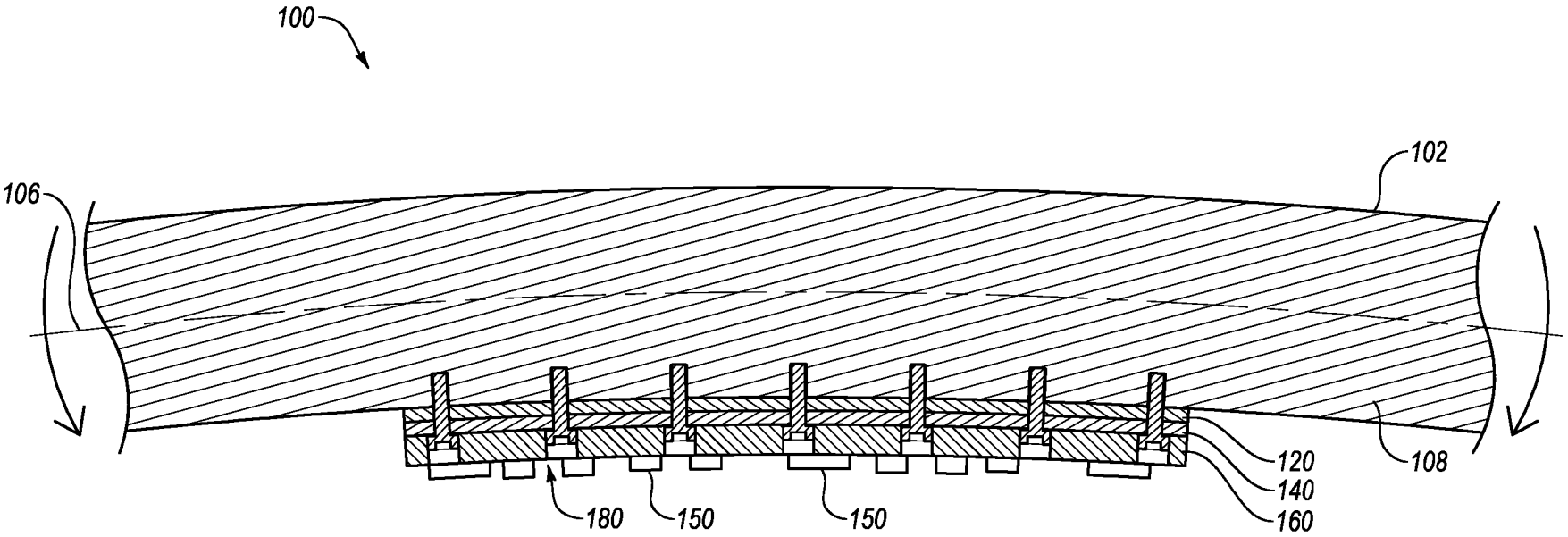
FIG. 4 depicts a cross-sectional view of a printed circuit board coupled to a chassis, according to one or more embodiments disclosed herein.

FIGS. 3 and 4 depict the tool 100 in bending. Such bending may occur, for example, when the tool 100 is passing through a bend or dog leg in a wellbore. Equation 1 depicts the formula for determining the bending stress, $\sigma_1$, in the chassis 102, where $E_1$ is elastic modulus of chassis material, c is the distance to the chassis surface 108 from a neutral axis 106, and r is the radius of curvature from the bend or dog-leg.

$$\sigma_1=(E_1*c)/r \quad \text{(Equation 1)}$$

Where $\epsilon_1$ is the strain, the equation is simplified, as shown in Equation 2.

$$\sigma_1=E_1*\epsilon_1 \quad \text{(Equation 2)}$$

Where $E_2$ is elastic modulus of low modulus spacer 120 and $\epsilon_2$ is the strain, the stress, $\sigma_2$, at the lower surface 126 of the low modulus spacer 120 that is in contact with the surface 108 of the chassis 102, is shown in Equation 3.

$$\sigma_2=E_2*\epsilon_2 \quad \text{(Equation 3)}$$

Since the strain is the same at surface 108 of the chassis 102 and the lower surface 124 of the low modulus spacer 120, because they are at the same distance from the neutral axis 106, $\epsilon_1$ is equal to $\epsilon_2$. By combining Equation 2 with Equation 3 and assuming $\epsilon_1$ is equal to $\epsilon_2$, Equation 4 is formed.

$$\sigma_1/\sigma_2=E_1/E_2 \quad \text{(Equation 4)}$$

By solving Equation 4 for $\sigma_2$, the stress at a lower surface 126 of the low modulus spacer 120, Equation 5 is formed.

$$\sigma_2=\sigma_1(E_1/E_2) \quad \text{(Equation 5)}$$

Equation 5 may be used to determine the stress at a lower surface 126 of the low modulus spacer 120.

Using Equation 5 and assuming there is no interference between the fastener and the aperture 140 of the electronics module 140, the stress $\sigma_3$ at the surface 124 of the low modulus spacer 120 and the surface 144 of the printed circuit board 145 of the electronics module 140 is approximately $\sigma_2$, the stress at the interface between the low modulus spacer 120 and the surface 108 of the chassis 102. This assumption works with materials like elastomers, polymers, composites, etc., that exhibit large displacement or strain with little increase in stress or load as compared to metallic alloys. For this approximation, $\sigma_2$, the stress at the lower surface 124 of the low modulus material 120 is assumed to be approximately equal to $\sigma_3$, the stress at the interface between the upper surface 126 of the low modulus spacer 120 and the lower surface 144 of the circuit board 145 of the electronics assembly 140.

Based on Equation 5 and the assumptions discussed above, the stress at the upper surface 126 of the low modulus spacer 120, 63 is equal to the ratio of the modulus, $E_1$, of the chassis 102 and the modulus, $E_2$, of the low modulus spacer 120.

As shown below in Equation 6, the tensile stress in the circuit board 145 of the electronics module 140 may be expected to have about, for example, approximately 1/10 the stress in the chassis, $\sigma_1$, when a low modulus spacer 120 with 1/10 of the elastic modulus of the chassis 102 is used.

$$\sigma_3=\sigma_1/10 \quad \text{(Equation 6)}$$

In this embodiment, the strain at the interface between the low modulus spacer 120 and printed circuit board 145 may also be the same, as shown in Equation 7.

$$\epsilon_3=\epsilon_1/10 \quad \text{(Equation 7)}$$

Testing with strain gages has shown that actual results are in line with this approximation. Typical data points with elastomer-based low modulus interfaces with $\epsilon_1=150\times10^{-6}$ at the chassis results in strain within a range of $\epsilon_3=15\times10^{-6}$ to $\epsilon_3=30\times10^{-6}$ at the printed circuit board.

As discussed above, the aperture 142 of the printed circuit board 145 is greater than the diameter 183 of the shank 196 of the fastener 190. In addition, the gap 189 between the fastener 190 and the inner surface of the aperture 142 of the circuit board 140 is such that even under bending during drilling operations, the fastener 190 may not contact the sidewall of the aperture 142. Should one or more fasteners 190 contact the sidewall of the aperture 142, the fastener 190 may impart a force onto the printed circuit board 145 and induce stress into the printed circuit board 145. Such contact may obviate the strain attenuation that would otherwise be gained by using the low modulus spacer 120 between the chassis 102 and the circuit board 145 of the electronics module 140.

Additionally, strain gages could be incorporated on the printed circuit board to aid in monitoring the accumulated strain and fatigue during the operational life of the circuit board 145 and/or electronic assembly 140.

As mentioned earlier, FIGS. 3 and 4 depict the tool 100 in different bending positions. These positions may depict different orientations of the tool 100 in a well bore. For example, during drilling operations the tool 100 may rotate within the well bore. When the tool 100 is located in a bend in the well bore, the tool may be subjected to cyclical bending loads. For example, the rotational displacement of the tool 100 in FIG. 4 is 180 degrees from the tool 100, as shown in FIG. 3. During operation, as the tool 100 rotates within the well bore, the upper surface 108 of the chassis 102, and thus the electronic components 150 and the circuit board 145 of the electronic assembly 140, may be subject to alternating tensile loads in the orientation shown in FIG. 3 and compression loads in the orientation shown in FIG. 4.

These alternating loads cause stress and strain on the electronic assembly 140 and, in particular, on the electrical traces in the circuit board 145 and the joints between the electronic components 150 and the circuit board 145. These alternating loads may fatigue the traces and joints which may lead to premature failure of the electronic assembly.

The lower the magnitude of the stress and strain in the electronic assembly 140, the longer the electronic assembly will last. Attenuating the strain on the electronic assembly with the low modulus spacer 120 attenuates the magnitude of the stress and strain imparted to the electronic assembly 140 by the chassis 102.

In some embodiments, materials for use in the low modulus spacer 120 may also be resistant to or exhibit little to no creep. Creep is the tendency of a solid material to move slowly or deform permanently under the influence of mechanical stresses.

The low modulus spacer 120 and the distributing component 194 may be made from low modulus materials such as, for example, delrin, polyamides, lexan, nylon, silicone composites, synthetic rubbers such as fluoroelastomers, nitrile, and viton. In some embodiments the low modulus material may be a composite material including or more low modulus material such as, for example, delrin, polyamides, lexan, nylon, silicone composites, synthetic rubbers such as fluoroelastomers, nitrile, and viton. In some embodiments the composite material may include reinforcing material, such as, for example, fibers or other material.

Figure 5:
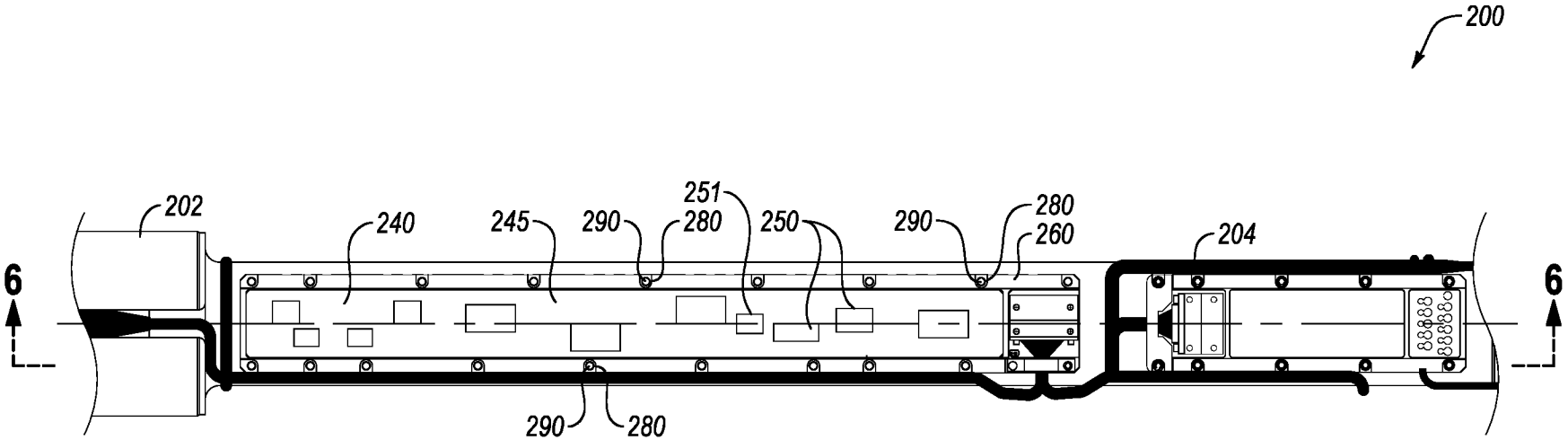
FIG. 5 depicts a top view of a printed circuit board coupled to a chassis, according to one or more embodiments disclosed herein.
Figure 6:
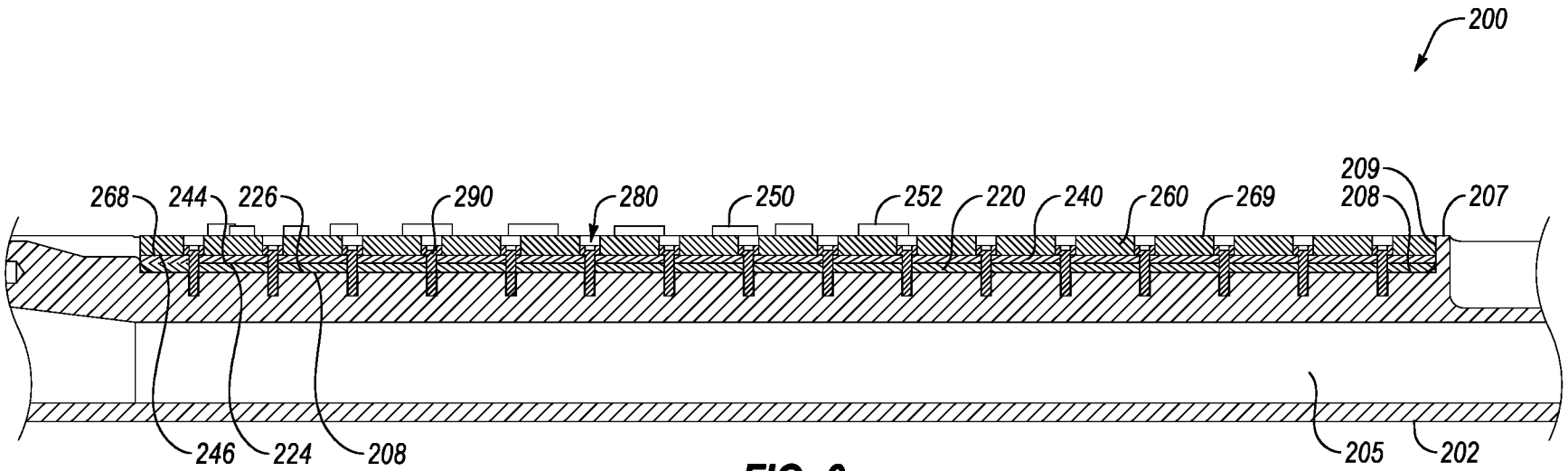
FIG. 6 depicts a cross-sectional view of a printed circuit board coupled to a chassis of FIG. 5, according to one or more embodiments disclosed herein.

FIGS. 5 and 6 show an embodiment of an electronics assembly 240 mounted to a chassis 202 for a tool 200. The tool 200 is a measurement subassembly of a downhole tool and may be used for measuring the properties of the well bore or formations surrounding the tool 200. The electronics assembly 240 may include electronic components 250 coupled to a circuit board 245.

As discussed above with reference to FIGS. 1 and 2, the electronic components 250 may be active, such as processors, memory, and integrated logic chips, or they may be passive, such as resistors, inductors, and capacitors. The electronic components 250 may also be other controller hardware, communication hardware, and other electronic components or devices. The electronic components 250 may be coupled to the circuit board 245 of the electronic assembly 240.

The electronic assembly 240 also includes a strain gage 251 mounted to the circuit board 245. The strain gage 251, along with some of the associated electronic components 250 may monitor, process, and/or record the strain and fatigue experienced by the electronic assembly 240, the circuit board 245, and/or electronic components 250 during operation of the tool 200.

In some embodiments, the electronic components 250 include leads that are soldered to through holes or pads on the circuit board 245. The solder that couples the electronic components 250 to the electronic assembly 240 may form both an electric and a physical connection to the circuit board 245.

The electronic assembly 240 is coupled to the chassis 202 of the tool 200 within a recess 209. In some embodiments, an upper surface 269 of a frame 260 may be flush with, or radially inward from, an outer surface 207 of the tool chassis 202. In some embodiments, an upper surface 252 of the electronic components 150 may be flush with, or radially inward from, the outer surface 207 of the tool chassis 202.

The electronic assembly 240 is coupled to the chassis 202 of the tool 200 using a combination of a frame 260, a low modulus spacer 220, and fasteners 290. The fasteners 290 clamp or otherwise couple the frame 260, electronics assembly 240, and low modulus spacer 220 to an outer surface 208 of the chassis 202.

FIG. 5 also shows power and electrical communication wires 204 for coupling the electronic components 250 to power and various other subsystems within the tool 200 and outside the tool 200, for example to recording and monitoring equipment located at the surface or another portion of the down hole tool.

FIG. 6 depicts a cross-sectional view of the tool 200 in FIG. 5. As shown in FIG. 6, the fastener 290 passes through the aperture 280 and engages with the frame 260 and the chassis 202 to clamp the frame 260, electronics assembly 240, and the low modulus material 220 to the chassis 202. As also shown in FIG. 6, a surface 268 of the frame 260 contacts an upper surface 246 of the electronics assembly 240. An opposing, lower surface 244 of the electronics assembly 240 contacts an upper surface 224 of the low modulus material 220 and an opposing, lower surface 226 of the low modulus material 220 contacts the outer surface 208 of the chassis 202. The clamping force between the fastener 290 and the chassis 202 is imparted by one surface 208, 224, 226, 244, 246, 268, onto an adjacent surface 208, 224, 226, 244, 246, 268.

FIG. 6 also shows a fluid path 205 within the chassis 202 of the tool 200 that provides a path for the flow of drilling fluid or mud.

With a low modulus material interface, such as the low modulus material spacer 220, inserted between electronics and chassis, the tensile strain transmitted from the chassis 202 to the electronics printed circuit board 245 of the electronics assembly 240 and components 250 during bending may be attenuated. The strain from the high elastic modulus chassis 202, which may be made from durable materials such as steel, coupled to the low modulus material spacer results in much lower relative stresses in the electronics module 140 as compared to the stress in the chassis 202.

The low modulus spacers 120, 220 may also attenuate the shock amplitude transmitted from the chassis 102, 202 to the electronic assembly 140, 240, and the electronic components 150, 250. In combination with the strain attenuation, this may aid providing high reliability and long fatigue life.

A few example embodiments have been described in detail above; however, those skilled in the art will readily appreciate that many modifications are possible in the example embodiments without materially departing from the scope of the present disclosure or the appended claims. Accordingly, such modifications are intended to be included in the scope of this disclosure. Likewise, while the disclosure herein contains many specifics, these specifics should not be construed as limiting the scope of the disclosure or of any of the appended claims, but merely as providing information pertinent to one or more specific embodiments that may fall within the scope of the disclosure and the appended claims. Any described features from the various embodiments disclosed may be employed in combination. In addition, other embodiments of the present disclosure may also be devised which lie within the scope of the disclosure and the appended claims. Additions, deletions and modifications to the embodiments that fall within the meaning and scopes of the claims are to be embraced by the claims.

Certain embodiments and features may have been described using a set of numerical upper limits and a set of numerical lower limits. It should be appreciated that ranges including the combination of any two values, e.g., the combination of any lower value with any upper value, the combination of any two lower values, or the combination of any two upper values are contemplated. Certain lower limits, upper limits and ranges may appear in one or more claims below. Numerical values are "about" or "approximately" the indicated value, and take into account experimental error, tolerances in manufacturing or operational processes, and other variations that would be expected by a person having ordinary skill in the art.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include other possible embodiments along with the full scope of equivalents to which such claims are entitled. Accordingly, the claims are not limited by the disclosure.

The invention claimed is:

1. A system for mounting electronics to a downhole tool, comprising:

a chassis, the chassis having a mounting surface;

an electronics assembly including a printed circuit board coupled to the chassis;

a low modulus spacer coupled to the chassis between the mounting surface of the chassis and the electronics assembly;

an aperture passing through the electronics assembly and the low modulus spacer and into the chassis, wherein the aperture includes:

a chassis diameter at the chassis; and an electronics assembly diameter at the printed circuit board and the low modulus spacer, at least a portion of the electronics assembly diameter being greater than the chassis diameter; and a fastener passing through the aperture to couple the low modulus spacer between the electronics assembly and the chassis, the fastener being secured to the chassis at the electronics diameter, the fastener coupling the electronics assembly and the low modulus spacer to the chassis, the fastener including a head, a head diameter of the head being greater than the electronics assembly diameter.

2. The system of claim 1, further comprising:

a frame coupled to the chassis, the aperture passing through the frame, the electronics assembly and the low modulus spacer being between the frame and the mounting surface of the chassis.

3. The system of claim 1, further comprising:

a gap formed between an outer surface of a shank of the fastener and a surface of the aperture formed through the electronics assembly and the low modulus spacer.

4. The system of claim 1, wherein the fastener is a bolt having a shank with a shank outer diameter; and the shank outer diameter being smaller than the electronics assembly diameter of the aperture at the printed circuit board and the low modulus spacer.

5. The system of claim 1 wherein the chassis includes a material with a first modulus of elasticity and the low modulus spacer includes a material of a second modulus of elasticity, the second modulus of elasticity of the low modulus spacer being lower than the first modulus of elasticity of the chassis.

6. The system of claim 5, wherein the second modulus of elasticity is 10 times less than the first modulus of elasticity.

7. The system of claim 1, wherein the low modulus spacer includes one or more of polymers, elastomers, fibers, and composite material.

8. The system of claim 1, further comprising:

a circuit board included in the electronic assembly; and a strain gage mounted to the circuit board to aid in measuring strain and fatigue of the circuit board.

9. The system of claim 1, wherein the aperture includes a spacer diameter, the spacer diameter being greater than the chassis diameter.

10. The system of claim 1, wherein the aperture is a blind aperture into the chassis.

11. A method of mounting electronics to a downhole tool, comprising:

mounting a low modulus spacer onto a surface of a chassis, the low modulus spacer including opposing first and second surfaces, the first surface of the spacer being in contact with the surface of the chassis;

mounting an electronics assembly including a printed circuit board to the low modulus spacer, the electronics assembly including opposing third and fourth surfaces, the third surface of the electronics assembly being in contact with the second surface of the low modulus spacer;

inserting a fastener into an aperture through the electronics assembly, the low modulus spacer, and the chassis, the aperture including a chassis diameter at the chassis and an electronics assembly diameter at the printed circuit board and the low modulus spacer, the electronics assembly diameter being larger than the chassis diameter, the fastener including a head, a head diameter of the head being greater than the electronics assembly diameter; and coupling the electronics assembly and the low modulus spacer to the chassis with a fastener bending the downhole tool, wherein bending the downhole tool includes:

applying a first stress to the chassis; and applying a second stress to the printed circuit board, the printed circuit board diameter being larger than the chassis diameter resulting in the second stress being lower than the first stress.

12. The method of claim 11, further comprising:

coupling a frame to the chassis, the electronics assembly and the low modulus spacer being coupled to the chassis, between the frame and a mounting surface of the chassis.

13. The method of claim 12, wherein the aperture is formed through the frame, and coupling the frame to the chassis includes passing the fastener through the aperture formed through the frame, the electronics assembly, and the low modulus spacer.

14. The method of claim 13, further comprising:

forming a gap between an outer surface of a shank of the fastener and a surface of the aperture formed through the electronics assembly and the low modulus spacer.

15. The method of claim 11, further comprising:

measuring strain on the electronics assembly and the chassis while bending the chassis, an electronics assembly strain being less than a chassis strain.

16. The method of claim 11, further comprising:

bending the chassis, wherein the fastener does not contact an aperture wall of the aperture at the electronics assembly when the chassis is bent.

17. A system for mounting electronics to a downhole tool, comprising:

a chassis including a first modulus of elasticity;

a frame;

an electronics assembly including a printed circuit board located between the frame and the chassis;

a spacer including a second modulus of elasticity, the second modulus of elasticity being lower than the first modulus of elasticity, the spacer being located between the electronics assembly and the chassis;

an aperture passing through the frame, the electronics assembly, the spacer, and into the chassis, the aperture including:

a frame diameter and shoulder at the frame;

an electronics assembly diameter at the printed circuit board and the spacer; and a chassis diameter and threads at the chassis; and a fastener securing the frame, the electronics assembly, and the spacer to the chassis, the fastener being threaded into the chassis at the threads, a head of the fastener engaging with the shoulder, the fastener including a head, a head diameter of the head being greater than the electronics assembly diameter.

18. The system of claim 17, the fastener including a shank above the threads, a shank diameter being less than the electronics assembly diameter.

19. The system of claim 18, the shank diameter being less than the electronics assembly diameter when the chassis is in a bent configuration.

20. The system of claim 19, wherein the shank does not contact a wall of the aperture at the electronics assembly in the bent configuration.

* * * * *